US006952080B2

(12) United States Patent
Acchione

(10) Patent No.: US 6,952,080 B2
(45) Date of Patent: Oct. 4, 2005

(54) STABILIZED ELECTRODES IN ELECTROLUMINESCENT DISPLAYS

(75) Inventor: Joe Acchione, Caledon (CA)

(73) Assignee: Ifire Technology Inc., Fort Saskatchewan (CA)

( * ) Notice: Subject to any disclaimer, the term of this patent is extended or adjusted under 35 U.S.C. 154(b) by 0 days.

(21) Appl. No.: 10/326,786

(22) Filed: Dec. 19, 2002

(65) Prior Publication Data

US 2003/0152803 A1 Aug. 14, 2003

Related U.S. Application Data

(60) Provisional application No. 60/341,242, filed on Dec. 20, 2001.

(51) Int. Cl.[7] ..... H05B 33/22

(52) U.S. Cl. ..... 313/506; 313/509; 428/690; 428/917

(58) Field of Search ..... 313/502–509, 313/498; 445/24; 428/690, 917, 212

(56) References Cited

U.S. PATENT DOCUMENTS 5,293,546 A * 3/1994 Tadros et al. ..... 359/269
5,432,015 A * 7/1995 Wu et al. ..... 428/690
5,454,892 A 10/1995 Kardon et al.
6,207,302 B1 * 3/2001 Sugiura et al. ..... 428/690
6,249,082 B1 * 6/2001 Fukuyoshi et al. ..... 313/479
6,403,204 B1 * 6/2002 Kitai et al. ..... 428/212
6,436,541 B1 * 8/2002 Sopko et al. ..... 428/432
6,514,891 B1 * 2/2003 Lee ..... 501/32
6,589,674 B2 * 7/2003 Li et al. ..... 428/690
6,672,922 B2 * 1/2004 Shirakawa et al. ..... 445/24
2001/0016253 A1 * 8/2001 Goda et al. ..... 428/212

FOREIGN PATENT DOCUMENTS

GB 943985 A 12/1963
JP 2001250691 A * 9/2001 ..... H05B/33/22

* cited by examiner

*Primary Examiner*—Karabi Guharay
*Assistant Examiner*—Sikha Roy
(74) *Attorney, Agent, or Firm*—Fay, Sharpe, Fagan, Minnich & McKee, LLP

(57) ABSTRACT

The invention relates to improving the stability of the lower electrodes in an electroluminescent display employing a thick film dielectric. The invention is an encapsulated electrode comprising an electrode of an electrically conductive metallic film. A layer of encapsulating material is provided on an upper and/or lower surface of the electrode layer. The encapsulating material reduces the risk of the electrode from becoming discontinuous and losing its electrical conductivity.

66 Claims, 4 Drawing Sheets

Au-Pb Crystal Structure Data

| Phase | Pearson Symbol | Struktur Bericht | Prototype | Model |
|---|---|---|---|---|
| fcc | cF4 | A1 | Cu | RK |
| $Au_2Pb$ | cF24 | C15 | $Cd_2Mg$ | CE |
| $AuPb_2$ | tI12 | C16 | $Al_2Cu$ | CE |
| $AuPb_3$ | tI32 | | $\alpha V_2S$ | CE |

Au-Bi Crystal Structure Data

| Phase | Pearson Symbol | Struktur Bericht | Prototype | Model |
|---|---|---|---|---|
| (Au) | cF4 | A1 | Cu | RK |
| $An_2Bi$ | cF24 | C15 | $Cu_2Mg$ | CE |
| (Bi) | hR2 | A7 | $\alpha$-As | RK |

STABILIZED ELECTRODES IN ELECTROLUMINESCENT DISPLAYS

This application claims the benefit of Provisional Application No. 60/341,242, filed Dec. 20, 2001.

FIELD OF THE INVENTION

The present invention relates to an electroluminescent display employing a thick film dielectric. More particularly, the invention relates to improving the stability of the lower electrodes in such a display.

BACKGROUND OF THE INVENTION

Thick dielectric electroluminescent displays (TDEL) provide a great advance in flat panel display technology. TDEL displays comprise a basic structure of a substrate upon which an electrically conductive film is deposited forming the first electrode. A thick film layer consisting of a ferroelectric material is then deposited on the electrically conductive film layer. A phosphor film is deposited on the thick film layer followed by an optically transparent but electrically conductive film to form the second electrode in the structure.

Various aspects of manufacturing TDEL displays are described in Applicant's U.S. Pat. Nos. 6,610,352, 6,589,674, 6,447,654, 6,617,782 and 5,432,015 and International Patent Applications PCT/CA01/01234 and PCT/CA00/00561. The disclosure of these aforementioned applications and issued patent are hereby incorporated by reference in their entirety into the present disclosure.

TDEL displays provide for several advantages over other types of flat panel displays including plasma displays (PDP), liquid crystal displays (LCD), thin film electroluminescent displays (TFEL), field emission displays (FED) and organic electroluminescent devices (OLED). For example, TDEL displays provide greater luminescence and greater resistance to dielectric breakdown as well as reduced operating voltage as compared to TFEL displays. This is primarily due to the high dielectric constant of the thick film dielectric materials used in TDEL displays which facilitates the use of thick layers while still facilitating an acceptably low display operating voltage. The thick film dielectric structure, when deposited on a ceramic or other heat resistant substrate, may withstand higher processing temperatures than TFEL devices, which are typically fabricated on glass substrates. This increased temperature tolerance facilitates annealing of subsequently deposited phosphor films to improve their luminosity and stability.

In the fabrication of a TDEL structure, sulfide phosphors are deposited in a hydrogen sulfide atmosphere or evolve hydrogen sulfide during deposition or subsequent thermal processing. The hydrogen sulfide or associated hydrogen may react chemically with the lower electrode films (typically gold) causing degradation by coalescing the gold into spheroids during phosphor deposition. It is believed that the coalescence is caused by the destruction of an oxide layer inherently present on the gold electrode, thereby increasing the surface tension of the film and causing the coalescence. Furthermore, hydrogen sulfide may reduce the metal oxides of the thick dielectric layer leading to the possibility of alloying with the gold lower electrode within the display.

It is therefore desirable to improve the stability of the lower electrodes present in a TDEL display to minimize any degradation thereof, especially during various steps involved in the production of the display such as phosphor deposition or thermal processing.

SUMMARY OF THE INVENTION

The present invention relates to improving the stability of lower electrodes present in a thick firm dielectric electroluminescent (TDEL) display employing a thick film dielectric. The display is characteristically constructed on a rigid heat resistant substrate by a method that entails first depositing the lower electrode structure, then depositing the thick dielectric structure and finally depositing a thin film structure incorporating phosphors and an upper conductor that is optically transparent according to the methods described in Applicant's U.S. Pat. No. 6,771,019, issued Aug. 03, 2004 (the disclosure which is incorporated herein in its entirety). The entire structure is covered with a sealing layer that protects the thick and thin film structures from degradation due to moisture or other atmospheric contaminants.

The stabilization of the lower electrodes in a TDEL display facilitates phosphor deposition and heat treatment at increased temperatures while minimizing any damage to the lower electrode structure. This provides improved phosphor performance. The stabilization of the lower electrodes also minimizes and decreases the possibility of the metal lower electrode alloying to any extent with reduced metal oxides of the thick film dielectric. Further, stabilization of the lower electrode reduces the likelihood of hydrogen sulfide permeating the lower gold electrode and coalescing the gold into spheroids during subsequent phosphor deposition.

In accordance with the present invention is a stabilized lower electrode present within a TDEL display.

Also in accordance with the present invention is a method and composition for minimizing degradation of lower electrodes present in a TDEL display.

According to an aspect of the present invention, the lower electrode of a TDEL display is provided on one or both sides with a layer of encapsulating material that does not decrease the fraction of the applied voltage across the phosphor structure.

In another aspect, the encapsulating material has a greater tendency to donate oxygen to a surface of the lower electrode than scavenge oxygen from the electrode. In this manner, the encapsulation layer minimizes chemical reduction of an oxide layer on the adjacent lower electrode, typically gold.

In yet another aspect, the encapsulating material is capable of being patterned.

In still a further aspect, the encapsulating material is electrically conductive.

In yet a further aspect, the encapsulating material has a high dielectric constant.

In a further aspect, the encapsulating material may comprise a non-stoichiometric compound that can exist over a range of the atomic ratio of oxygen in the compound so that its crystal structure and hence its morphological stability and intimate contact with the lower electrode layer is not disrupted due to a partial loss of oxygen caused by reaction with a reducing agent.

In a preferred aspect, the encapsulation material comprises an oxide. Suitable oxides for use in the present invention are electrically conductive non-stoichiometric oxides, provided that they adhere well to the lower electrode and to the overlying thick film dielectric structure and do not adversely affect the dielectric constant or other electrical properties of the dielectric material. A suitable oxide is not overly subject to reduction in the presence of hydrogen, hydrogen sulfide or other reducing vapours that may be present during display processing or operation to the extent that it may lose its ability to prevent reduction of the oxide layer on the surface of the gold.

In a most preferred aspect of the invention, the encapsulating material comprises indium tin oxide (ITO) and the electrode comprises gold. The indium tin oxide minimizes any reduction and destruction of the oxide layer contained on the gold electrode as well as minimizing thinning of the gold electrode layer.

In accordance with a further embodiment of the invention, the encapsulating material may comprise a dielectric material with a high dielectric constant. A preferred dielectric material is barium titanate.

It is understood that a combination of oxide and dielectric material can be used to encapsulate the lower gold electrode in a TDEL display.

According to another aspect of the invention is a method for increasing the adhesion between the gold electrode layer and substrate in a TDEL display, the method comprising providing a layer of encapsulating material between the gold electrode layer and substrate, wherein the material does not significantly reduce the electrical conductivity of the gold electrode layer.

According to another aspect of the invention is a method for increasing the adhesion between the gold electrode layer and the thick film dielectric layer in a TDEL display, the method comprising providing a layer of encapsulating material between the gold electrode layer and the thick film dielectric wherein the material does not significantly reduce the electrical conductivity of the gold electrode layer.

According to yet another aspect of the invention is a method for minimizing diffusion of gold into adjacent substrate and/or thick film dielectric layer in a TDEL display, the method comprising providing a layer of encapsulating material between the gold electrode layer and substrate and also between the gold electrode layer and the thick film dielectric layer.

According to still a further aspect of the present invention there is provided an encapsulated electrode comprising;

an electrode layer comprising an electrically conductive metallic film;

an encapsulating material provided on an upper and/or lower surface of said electrode layer, said material reducing the risk of the electrode from becoming discontinuous and losing its electrical conductivity;

wherein said encapsulated electrode is present in a thick film dielectric electroluminescent display.

According to another aspect of the present invention there is provided a thick film dielectric electroluminescent display comprising;

a rigid heat resistant substrate;

a lower electrode layer directly adjacent said substrate, said lower electrode layer comprising an electrically conductive metallic film;

a layer of encapsulating material provided on an upper and/or lower surface of said electrode layer, said encapsulating material reducing the risk of the electrode from becoming discontinuous and losing its electrical conductivity;

a thick film dielectric layer adjacent said electrically conductive layer of encapsulating material provided on an upper surface of said electrode layer;

a phosphor film deposited on said thick film dielectric layer; and an upper electrode layer comprising an optically transparent electrically conductive film.

According to still a further aspect of the present invention is a stabilized electrode comprising;

an electrically conductive gold film layer having an upper surface and a lower surface, said gold film having a thickness of about 100 nm to about 1000 nm;

a layer of indium tin oxide provided on the upper surface of said gold layer having a thickness of about 20 nm to about 500 nm; and a layer of indium tin oxide provided on the lower surface of said gold layer having a thickness of about 10 nm to about 60 nm;

wherein said stabilized electrode is present within a thick film dielectric electroluminescent display.

According to still a further aspect of the present invention is a stabilized electrode comprising;

an electrically conductive gold film layer having an upper surface and a lower surface, said gold film having a thickness of about 100 nm to about 1000 nm;

a layer of barium titanate provided on the upper surface of said gold layer; and a layer of barium titanate provided on the lower surface of said gold layer;

wherein said stabilized electrode is present within a thick film dielectric electroluminescent display.

According to another aspect of the present invention is a method for stabilizing an electrode within a thick film dielectric electroluminescent display, said method comprising;

providing a layer of encapsulating material on an upper and/or lower surface of said electrode, said material reducing the risk of the electrode from becoming discontinuous and losing its electrical conductivity.

BRIEF DESCRIPTION OF THE DRAWINGS

The present invention will become more fully understood from the description given herein, and from the accompanying drawings, which are given by way of illustration only and do not limit the intended scope of the invention.

DETAILED DESCRIPTION OF THE INVENTION

Figure 1:
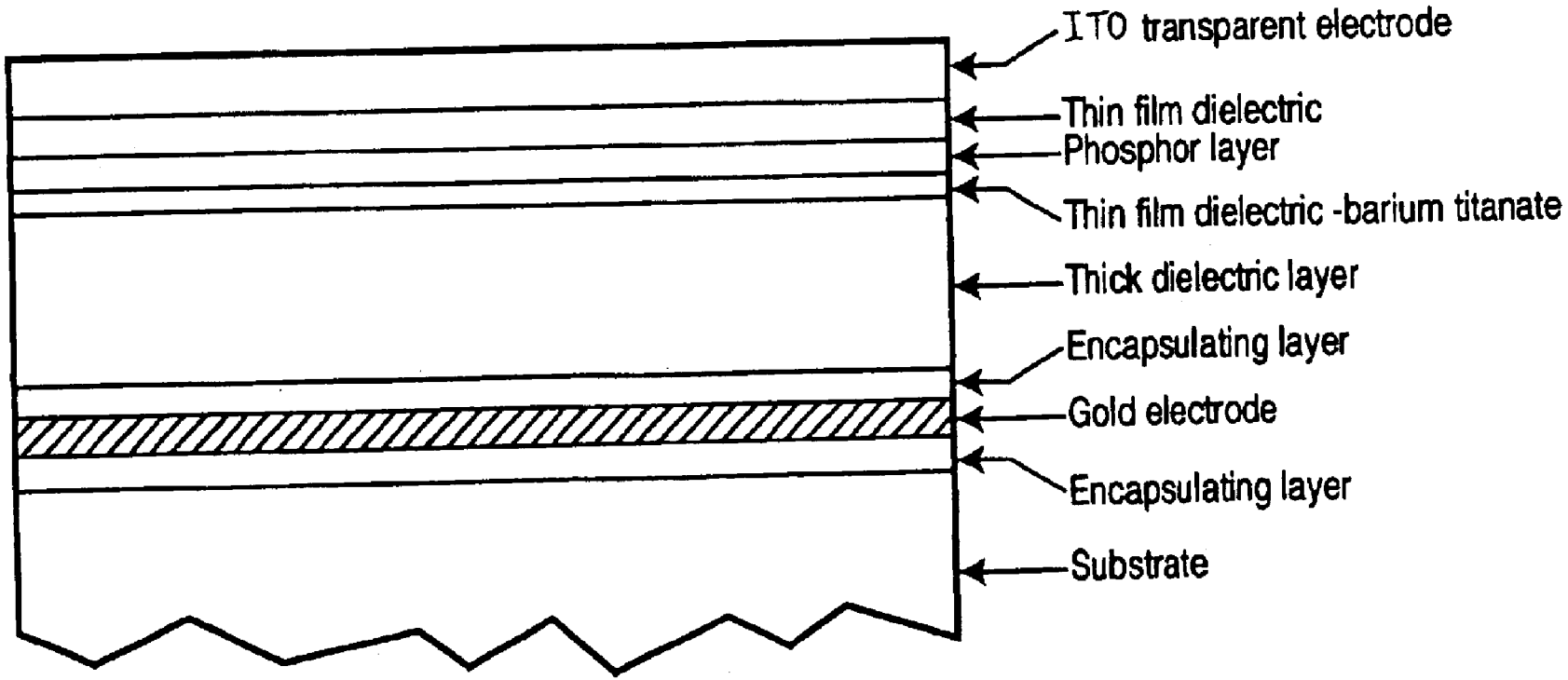
FIG. 1 shows a section of a thick film electroluminescent element display showing the position of the encapsulation layer(s) of the present invention.

The present invention relates to the encapsulation of the lower electrode in a thick film dielectric electroluminescent (TDEL) display constructed on a rigid substrate using a process whereby the lower electrodes are deposited on the substrate prior to deposition of the thick dielectric film or the phosphor structure.

More specifically, the invention is the provision of one or more layers of an encapsulating material for the lower electrode structure (typically gold film) of a thick film electroluminescent display. Such layer(s) of encapsulating material act to protect the electrode and thus help to prevent reduction of the surface oxide layer on the gold film that is present to reduce the surface tension of the gold to a point where the gold film comprising the electrode structure does not break up into spheroidal particles to become mechanically discontinuous and lose electrical conductivity. The encapsulating material also helps to prevent any substantial alloying of the any reduced metal oxide present in the thick dielectric layer with the gold lower electrode.

The encapsulating layer(s) of the present invention generally comprise a material having two or more of the following properties:

- does not significantly decrease the fraction of the applied voltage across the phosphor structure (FIG. 1);
- minimizes permeation of hydrogen sulfide and sulfide containing vapours into the gold electrode layer;
- is capable of being patterned;
- has a crystal structure that is not substantially adversely affected in the presence of reducing agents present during TDEL display processing;
- adheres to the lower electrode structure as well as the thick film dielectric structure;
- minimizes reduction of oxide layer of lower electrode;
- facilitates adhesion of the lower electrode to substrate;
- facilitates adhesion of the lower electrode to the overlying thick film dielectric structure; and
- acts as a barrier to in-diffusion of species from adjacent substrate and/or thick film dielectric structure.

It is desirable that the encapsulation material for the lower electrode be a dense crystalline material that can exist in a non-stoichiometric state with respect to the ratio of oxygen to metal atoms while maintaining an essentially unchanged crystal structure. In particular, the material should contribute oxygen to maintain an oxide layer on the gold electrode layer in the atmosphere of a reducing agent such as hydrogen sulfide that may permeate the display structure during display processing. The crystal structure of the oxygen deficient encapsulating layer should not be disrupted to the extent that its continuity and crystal density are adversely affected in the context of the functional requirements of the encapsulation layer.

The layer(s) of encapsulating material may comprise a non-stoichiometric compound that can exist over a range of the atomic ratio of oxygen in the compound so that its crystal structure and hence its morphological stability and intimate contact with the gold layer is not disrupted due to a partial loss of oxygen caused by reaction with a reducing agent. The material must also be capable of being patterned to electrically isolate adjacent lower electrodes.

As the encapsulating material is selected to minimize chemical reduction of an oxide layer on the adjacent gold, a suitable material in one embodiment of the invention is an oxide with a greater tendency to donate oxygen to the surface of the gold film than to scavenge oxygen from it.

In a preferred embodiment of the present invention, a suitable material for the encapsulation layer is indium tin oxide (ITO), which is known to exist over a range of oxygen atomic ratios. Indium tin oxide is electrically conductive with a conductivity sufficiently high that an appreciable voltage drop does not develop across a thin film of the material incorporated into a thick dielectric electroluminescent display when the display is operated with voltage pulses typically used to drive the display. As is understood by those of skill in the art, other electrically conductive non-stoichiometric oxides may also be suitable for the present invention.

In another embodiment of the present invention, the encapsulating material may be a dielectric material with a high dielectric constant. One such material is barium titanate. As is understood by those of skill in the art, other dielectric materials/compounds may also be used in the present invention so long as they also have the aforementioned properties described for the encapsulating material.

It is understood by those of skill in the art that a combination of suitable oxide and suitable dielectric material may be used in accordance with the present invention. For example, a layer of indium tin oxide can be used to encapsulate the upper surface of a gold electrode and a layer of barium titanate may be used to encapsulate the lower surface of the gold electrode. Alternatively, this can be rearranged to provide the barium titanate encapsulating layer on the upper surface of the gold electrode and the indium tin oxide encapsulating layer may be provided on the lower surface of the gold electrode.

The encapsulating material of the invention may be used to encapsulate the upper and/or lower sides of the gold electrode. However it is beneficial to encapsulate both upper and lower sides of the gold electrode layer since reducing vapours may penetrate from between the gold and the substrate as well as from between the gold and the thick dielectric layer.

It is further understood by one of skill in the art, that the encapsulating material as provided on the lower side of the gold electrode need not comprise a material with a high dielectric constant since there is no issue of a voltage drop present between the substrate layer and the lower gold electrode.

The layer(s) of encapsulating material may be applied onto the substrate or gold electrode of the TDEL display by a variety of methods including, but not limited to, sputtering.

The layer(s) of encapsulating material must be sufficiently thick to provide an essentially continuous layer so that there is no substantial contact between the gold layer and adjacent layers but not too thick in order to avoid difficulties with mechanical stress due to the difference in thermal expansion coefficient between the encapsulation material and the substrate and thick film materials. The thickness of the electrically conductive material of the encapsulation layers may range from about 10 nm to 500 nm, preferably from about 25 nm to about 450 nm. More preferably, the lower layer of electrically conductive material forming an encapsulation layer between the substrate and the gold electrode layer may have a thickness of about 10 nm to about 60 nm, preferably about 30 nm to 60 nm. It is preferred that the upper layer of electrically conductive material on the gold electrode forming an encapsulating layer have a thickness of about 20 nm to about 500 nm, preferably from about 100 nm to about 450 nm.

The thickness of the gold layer should typically be in the range of about 100 nm to about 1000 nm, preferably about 150 nm to about 250 nm, with the thickness dependent on the requirements for electrical conductivity of the gold electrodes for a particular display design. The gold may be derived from an organometallic gold formulation that creates an oxide on the surface of the gold when it is fired to form a metallic gold film. It may also be deposited using physical vapour deposition methods, provided that means are provided to form an oxide layer between the gold and the encapsulation layers that is sufficient to modulate the surface tension of the gold in contact with the electrically conductive encapsulating material so that it maintains a continuous thin film and does not form discontinuous spheroidal particles so as to cause a loss of electrical conductivity along the film.

While ranges are provided for the total thickness of the encapsulating material as well as ranges as provided on top or below the electrode and preferred ranges, one of skill in the art would readily understand that not only are these ranges applicable to the presently claimed invention but also any sub-range thereof. For example, while the range for the total thickness of encapsulating material is provided as 10 nm to 500 nm, one of skill in the art may contemplate using from about 20 nm–450 nm, 30 nm–400 nm, 50 nm–350 nm and so forth as representative examples. Similarly, the electrode thickness is provided as about 100 nm to about 1000 nm, preferably 150 nm to about 250 nm. However, the thickness of the electrode used may be any sub-range thereof as for example 200 nm–250 nm or 200 nm–800 nm and so forth.

The present invention provides for increased stability of the gold electrodes as present within a TDEL structure through a variety of mechanisms.

Firstly, the thick dielelctric structure is designed to provide a high resistance against dielectric breakdown when the display is operated at a voltage exceeding 200 volts that is required to provide the necessary display luminance. It also has a high dielectric constant to minimize the voltage drop across the dielectric structure and thereby maximizes the voltage across the phosphor for a given applied voltage. Generally, the phosphor delivers greater luminance with increasing voltage across the phosphor. Therefore, it is desirable to minimize the voltage drop across any additional layers that may lie between the lower and upper conductor layer in the display. This may be accomplished by minimizing the thickness of such layers, or by incorporating layers with a high dielectric constant. Stabilizing the lower electrode with electrically conductive indium tin oxide layer(s) or barium titanate layer(s) may help to minimize any voltage drop between layers in the display.

Secondly, the provision of encapsulating layer(s) surrounding the lower electrodes in the TDEL display helps to prevent reduction of the oxide layer of the gold electrode. For example, the thick dielectric structure typically comprises a sintered perovskite piezoelectric or ferroelectric material such as PMN-PT with a dielectric constant of several thousand and a thickness greater than about 10 micrometers to prevent dielectric breakdown. This structure is permeable to a small degree to vapours, containing hydrogen sulfide as an example, present during display processing and during display operation. Such vapours may act to reduce the gold lower electrode such that loss of the oxide layer occurs. The oxide layer on the gold is beneficial to prevent coalescence of the gold leading to electrical discontinuity. The perovskite dielectric materials may themselves have a catalytic effect on adjacent materials due to a high density of energetic electrons at the surface of the perovskite material, thereby increasing the rate at which reduction of the oxide of the gold may occur.

Figure 2:
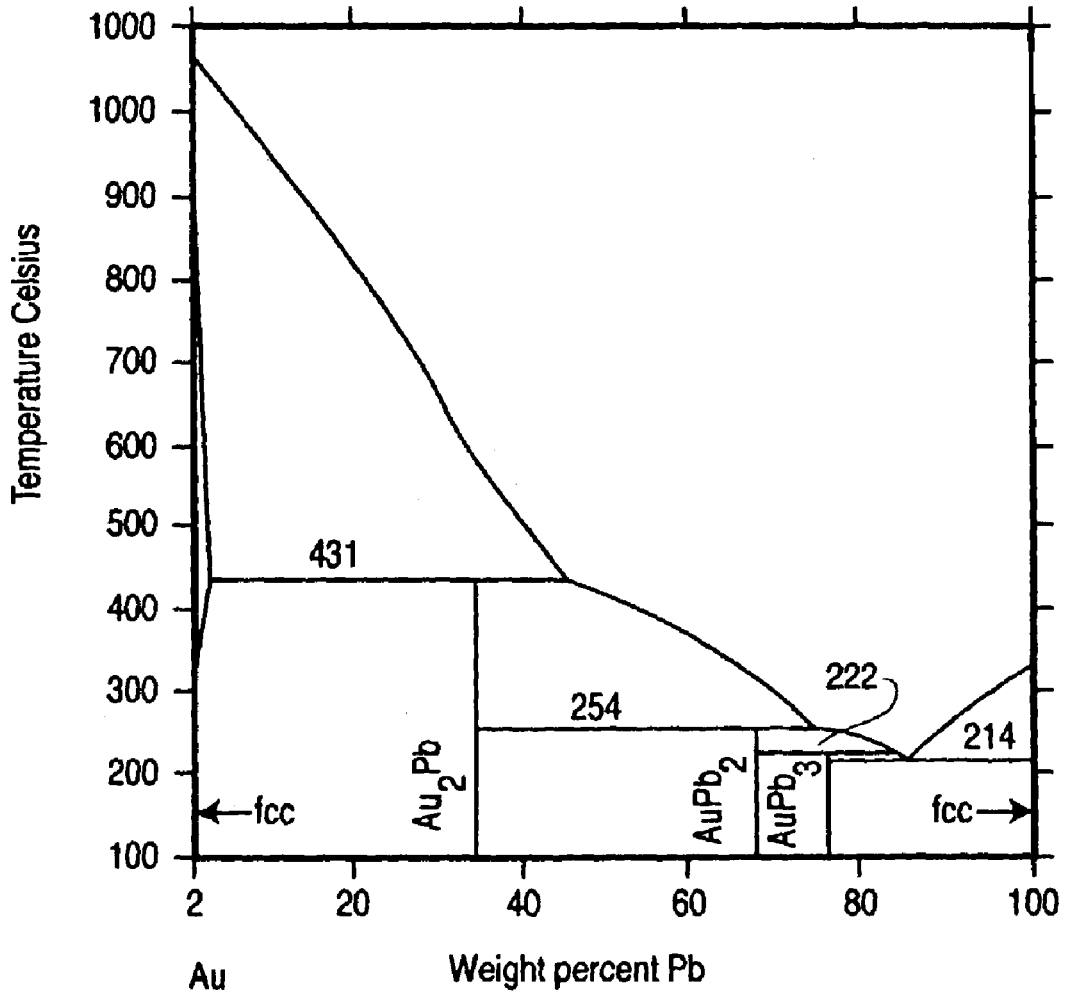
FIG. 2 shows a binary phase diagram for gold and lead.
Figure 3:
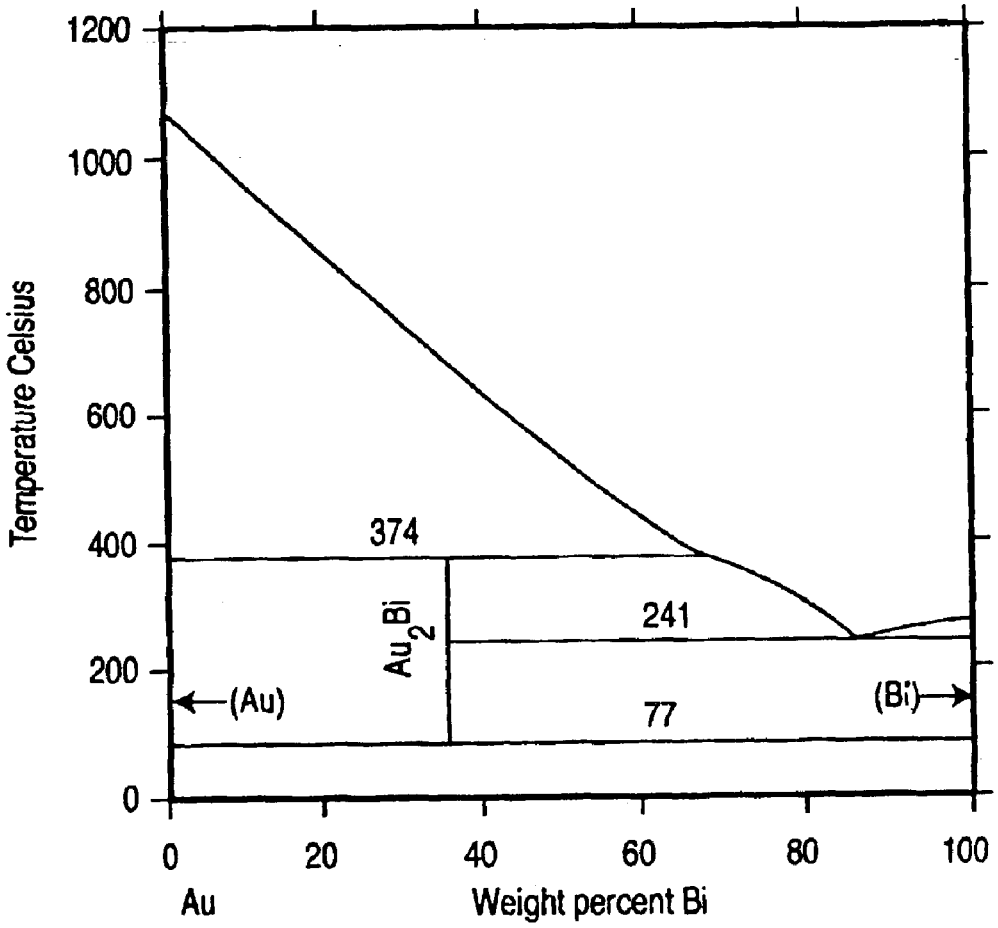
FIG. 3 shows a binary phase diagram for gold and bismuth.

Thirdly, the provision of encapsulating layer(s) surrounding the lower gold electrode helps to prevent alloying of the gold with elements. From the thick film dielectric used in the displays. Such alloying may reduce the melting temperature of the gold thus reducing the maximum temperature at which the display can be exposed during subsequent processing steps. Typically, the thick film dielectric material contains lead and may contain bismuth and other easily reduced metals. Although these are normally present as oxides, the lead or bismuth may partially be reduced to metal if reducing agents are employed during process steps used in the fabrication of the displays. The hydrogen sulfide commonly used as a process gas during deposition and is known to reduce lead. Once reduced, and especially if the metals have an appreciable vapour pressure at the processing temperatures used such as with lead, the metals may alloy with the gold. Reaction of these metals with the gold to form alloys, inter-metallic compounds or composites thereof may be appreciable even though only a small portion of the metals is reduced by in-process reducing agents. This is due to the relatively large ratio of the thickness of the dielectric layer to the gold layer (typically 20:1 to 50:1). FIGS. 2 and 3 show binary phase diagrams for the gold lead and gold bismuth systems. From the figures it can be seen that a melting point reduction of 250° C. may occur for about 20 atomic weight percent lead or bismuth in the gold.

Figure 4:
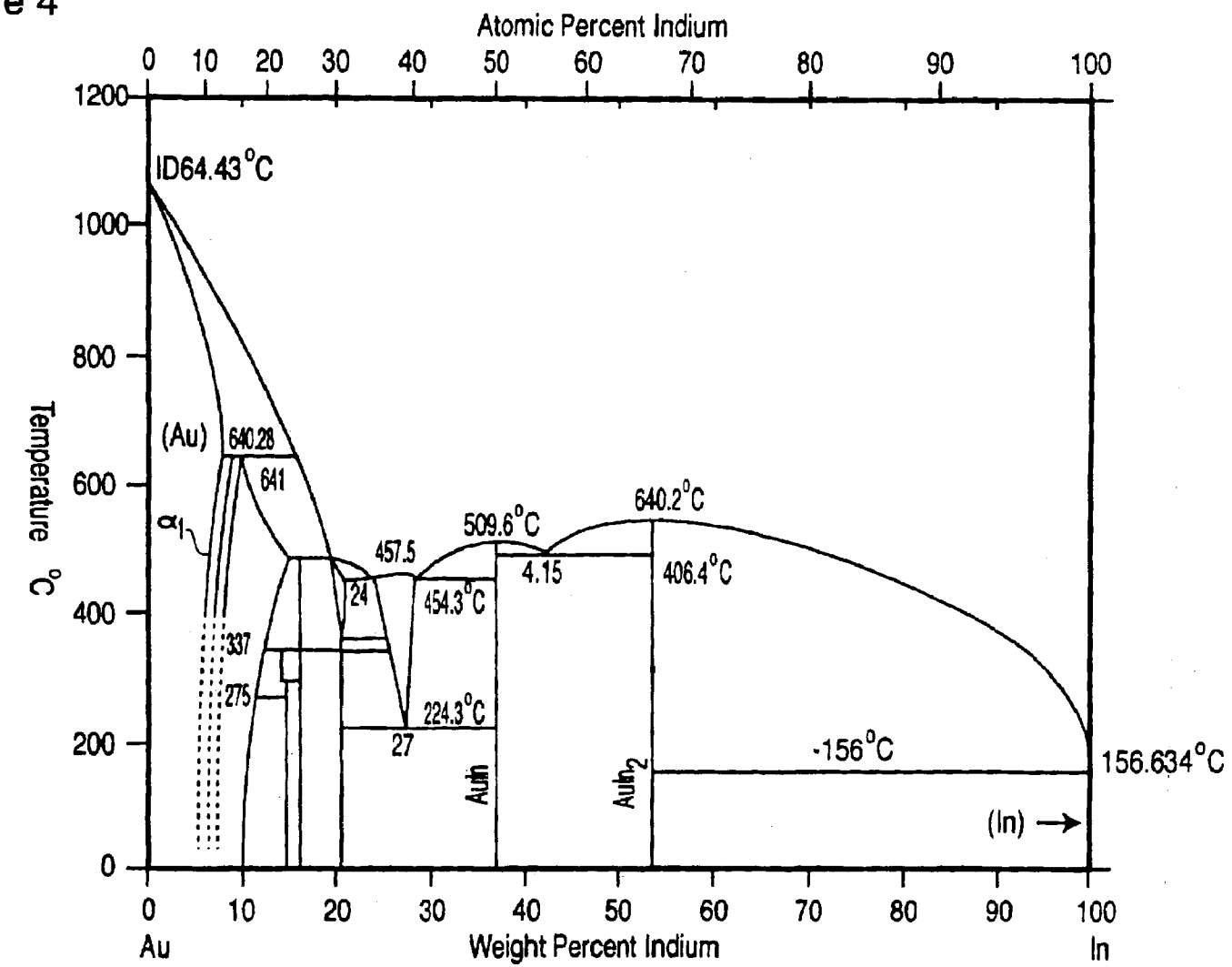
FIG. 4 shows a binary phase diagram for gold and indium.

Fourth, the provision of one or more encapsulating layers helps to provide a strong bond between the gold and the substrate as well as between the gold and the overlying thick film layers. Typically a strong bond is achieved if there is some inter-diffusion of species in the layers adjacent to the gold into the gold, provide that these do not significantly reduce the electrical conductivity of the gold. Conversely, it is desirable to minimize diffusion of gold into the adjacent layers to avoid degradation of the thick film dielectric layers and to prevent an increase in the electrical resistivity of the gold caused by a thinning of the gold layer and a possible concomitant loss of electrical continuity. FIG. 4 shows a binary phase diagram for the gold indium system. It is seen from the figure that indium will dissolve in gold up to about 5 atomic percent at temperatures up to about 900° C., encompassing the range of temperatures encountered in the fabrication of thick film electroluminescent displays. Further, it can be seen that there is no significant solubility of gold in indium, indication that gold should not diffuse into ITO in a reducing atmosphere where the oxygen content may be significantly reduced at the gold ITO interface.

Lastly, the present invention also serves to provide a barrier to in-diffusion of species from the adjacent thick film layers and also the substrate material to prevent an increase in the electrical resistivity of the gold or a decrease in the melting temperature of the gold as may happen when it is alloyed with other chemical elements.

In summary, the present invention provides a stable and high quality TDEL display in which the lower electrodes are encapsulated with one or more layers of a material that helps to stabilize the electrodes in such a display.

The above disclosure generally describes the present invention. A more complete understanding can be obtained by reference to the following specific Examples. These Examples are described solely for purposes of illustration and are not intended to limit the scope of the invention. Changes in form and substitution of equivalents are contemplated as circumstances may suggest or render expedient. Although specific terms have been employed herein, such terms are intended in a descriptive sense and not for purposes of limitation.

EXAMPLES

The following examples detail the fabrication of and test results for electroluminescent elements incorporating encapsulating layers deposited using a sputtering process, but it is understood by those with skill in the art that such layers may be deposited by any means that enables the deposition of a layer that effectively stabilizes an oxide coating on the gold during the fabrication process to prevent the gold from forming discontinuous spheroidal particles.

Example 1

An electroluminescent display was fabricated on a 1.0 mm thick 17 cm×21 cm alumina substrate (FIG. 1). The substrate was cleaned using standard methods known in the thick film hybrid circuit art. A film of indium tin oxide (ITO)

with a thickness of 600 Angstroms was then sputtered onto the alumina substrate in an Ulvac model SMD-400 sputtering tool. For this deposition the substrate was held at a temperature of 150° C. The deposition was done in an argon/oxygen atmosphere at a pressure of 2.5 millitorr. The argon flow rate was 75 sccm and the oxygen flow rate was 2.0 sccm. The sputtering target composition was 9 parts by weight indium oxide to 1 part tin oxide. During the sputtering process the substrate was passed by the target at a rate of 2.3 centimeters per minute for a total of two passes. The average rate of film growth was about 1 nm per second.

Onto the ITO film was then sputtered a 170 nm gold film. The gold film deposition was done with the substrate at about 22° C. For this deposition, the sputtering system was evacuated to a base pressure of $6\times10^{-7}$ torr prior to deposition and the deposition was carried out under an argon pressure of $7\times10^{-3}$ torr. During the deposition process the substrate was moved by the target in a single pass. The average rate of film growth was about 170 nm per minute.

After gold film deposition, a second 430 nm thick ITO film was sputtered onto the substrate on top of the gold film layer. The deposition conditions were the same as for the first ITO layer, except that the substrate was passed by the target 20 times to achieve the final desired thickness.

To pattern the deposited layers to form a set of parallel electrodes a series of photolithographic steps were performed. First, the top layer of ITO was patterned using a negative resist (Arch Chemicals Ltd. of Norwalk Conn.) and etched using LCE-12™etchant at a temperature of about 45° C. The etchant comprised an aqueous solution of 18% by weight hydrochloric acid, 2% by weight nitric acid, 10% by weight ferric chloride and the balance being water. Next, the gold underlying the removed ITO was etched away using an aqueous solution of 42% by weight potassium iodide, 3% by weight iodine 1% by weight Fisher Scientific All Purpose Cleaner surfactant and the balance being deionized water. Finally, the underlying ITO was etched using the LCE-12™etchant. Following patterning, the substrate was fired in air at about 850° C. for about 15 minutes in a belt furnace.

A 22 cm diagonal 320 by 240 pixel electroluminescent having a thick film dielectric layer was constructed on a substrate. A thick film composite dielectric layer comprising a thick film dielectric layer screen printed and fired using PMN-PT based paste 98-42 from MRA (North Adams, Mass., U.S.A.) or from Heraeus CL-90-7239 (Conshocken, Pa. U.S.A.) and two layers of lead zirconate-titanate spin coated and fired using a metal organic deposition process were sequentially deposited on the patterned ITO sandwiched gold coated substrate using the methods disclosed in Applicant's U.S. Pat. No. 6,771,019, filed Aug. 03, 2004. A barium titanate layer was deposited on top of the thick film structure using the procedure described in Applicant's U.S. Pat. No. 6,589,674, issued Jul. 08, 2003 (the entirety of which is incorporated herein by reference). The phosphor structure for the display incorporated a magnesium barium thloaluminate phosphor film about 0.4 micrometers thick deposited according to methods described in applicant's U.S. patent application Ser. No. 09/1798,203 (now abandoned) (the entirety of which is incorporated herein by reference in its entirety). During the phosphor deposition the substrate was held at a temperature of about 400° C. to about 550° C. and the deposition was carried out in an atmosphere of hydrogen sulfide at a pressure of about $10^{-}4$ millitor. The phosphor was annealed at a Peak temperature of about 750° C. under nitrogen for about 5 minutes in a belt furnace. A thin film alumina dielectric layer and an indium tin oxide transparent conductor layer were deposited on top of the phosphor layer to complete the device.

The electrical conductivity of one of the indium tin oxide encapsulated gold row electrodes on the display was measured immediately following deposition of the encapsulated gold layer, following deposition and firing of the composite dielectric structure, but before exposure to hydrogen sulfide and phosphor deposition and finally after completion of the display. The results are shown in Table 1.

Example 2

A display was built with the lower electrode constructed of organometallic gold that was not encapsulated between ITO layers. This display was identical to the in aforementioned Example 1, except that the lower electrode layers comprised gold deposited using an organometallic paste as disclosed in Applicant's U.S. patent application Ser. No. 09/792,203 (now abandoned) (the disclosure of which is incorporated herein in its entirety). The gold layer was 450 nm thick, and again, not encapsulated with indium tin oxide layers. As for the display in Example 1,the electrical resistance of one of the rows on this display was measured after gold deposition, after thick film deposition and firing, and after the device was completed. These results are shown in Table 1. The results demonstrate that display incorporating the ITO encapsulated gold layer only displayed a modes change in the electrical conductivity during processing. However, the display with the unencapsulated gold layer demonstrated a large decrease in electrical conductivity, despite its greater thickness.

Although preferred embodiments of the invention have been described herein in detail, it will be understood by those skilled in the art that variations may be made thereto without departing from the spirit of the invention.

TABLE ONE

A Relative Conductivity of Gold Electrodes at Various Process Stages

| Electrode | Process Stage Unencapsulated | ITO Encapsulated Gold Electrode | Gold |
|---|---|---|---|
| 1. | After gold deposition and patterning | 1.0 | 1.0 |
| 2. | After thick film processing | 1.5 | 0.9 |
| 3. | After phosphor deposition and heat treatment | 0.9 | 0.4 |

What is claim is:

1. An encapsulated electrode for an electroluminescent display incorporating a thick film dielectric layer, said electrode comprising;

an electrode layer comprising an electrically conductive metallic film having an upper and lower surface;

a thick film dielectric layer adjacent said upper surface of said electrode layer;

a layer of encapsulating material provided between said upper surface of said electrode layer and said thick film dielectric layer, and a layer of encapsulating material provided on said lower surface of said electrode, said material reducing the risk of the electrode from becoming discontinuous and losing its electrical conductivity, said encapsulating material on said upper and lower surface having a thickness of about 10 nm to about 500 nm, said encapsulating material on said lower surface is being selected from barium titanate and indium tin oxide.

2. The encapsulated electrode of claim 1, wherein said encapsulating material does not decrease the fraction of the applied voltage across a phosphor film present in said thick film dielectric electroluminescent display.

3. The encapsulated electrode of claim 1, wherein said encapsulating material acts as a barrier to in-diffusion of species into said electrode from an adjacent substrate and/or thick film dielectric structure present in said thick film dielectric electroluminescent display.

4. The encapsulated electrode of claim 1, wherein said encapsulating material increases adhesion between the electrode and a substrate material that forms part of the thick film dielectric electroluminescent display.

5. The encapsulated electrode of claim 1, wherein said encapsulating material increases adhesion between the electrode and a thick dielectric layer present within the thick film dielectric electroluminescent display.

6. The encapsulated electrode of claim 1, wherein said electrically conductive metallic film has a surface oxide layer and said encapsulating material minimizes chemical reduction of said surface oxide layer.

7. The encapsulated electrode of claim 6, wherein said encapsulating material has a greater tendency to donate oxygen to a surface of said electrode than scavenge oxygen from said electrode.

8. The encapsulated electrode of claim 1, wherein said encapsulating material is a dense crystalline material having a crystal structure that is not disrupted in the presence of a reducing agent selected from the group consisting of hydrogen sulfide, sulfur, sulfur vapour and sulfide bearing vapours.

9. The encapsulated electrode of claim 1, wherein said encapsulating material on said upper surface has a thickness of about 20 nm to about 500 nm.

10. The encapsulated electrode of claim 9, wherein said encapsulating material on said upper surface has a thickness of about 25 nm to about 450 nm.

11. The encapsulated electrode of claim 9, wherein said encapsulating material on said upper surface has a thickness of about 100 nm to about 450 nm.

12. The encapsulated electrode of claim 1, wherein said encapsulating material on said lower surface has a thickness of about 25 nm to about 450 nm.

13. The encapsulated electrode of claim 12, wherein said encapsulating material on said lower surface has a thickness of about 10 nm to about 60 nm.

14. The encapsulated electrode of claim 13, wherein said encapsulating material on said lower surface has a thickness of about 30 nm to about 60 nm.

15. The encapsulated electrode of claim 1, wherein said encapsulating material is indium tin oxide.

16. The encapsulated electrode of claim 1, wherein said encapsulating material is a compound having a high dielectric constant.

17. The encapsulated electrode of claim 16, wherein said compound is barium titanate.

18. The encapsulated electrode of claim 1, wherein said electrode has a thickness of about 100 nm to about 1000 nm.

19. The encapsulated electrode of claim 18 wherein said electrode has a thickness of about 150 nm to about 250 nm.

20. The electrode of claim 18, wherein said electrode is a metallic gold film.

21. The encapsulated electrode of claim 1, wherein said encapsulating material comprises indium tin oxide.

22. The encapsulated electrode of claim 1, wherein said encapsulating material on both said upper and lower surfaces of said electrode layer comprises barium titanate.

23. The encapsulated electrode of claim 1, wherein said encapsulating material provided on said upper surface of said electrode layer is indium tin oxide and said encapsulating material provided on said lower surface of said electrode is barium titanate.

24. The encapsulated electrode of claim 1, wherein said encapsulating material provided on said upper surface of said electrode is barium titanate and said encapsulating material provided on said lower surface of said electrode is indium tin oxide.

25. A thick film dielectric electroluminescent display having a thick film dielectric layer and an encapsulated lower electrode, said display comprising;

an electrode layer comprising an electrically conductive metallic film having an upper and lower surface;

a thick film dielectric layer adjacent said upper surface of said electrode layer;

an encapsulating material provided on said lower surface of said electrode, said encapsulating material minimizing the electrode from becoming discontinuous and losing its electrical conductivity.

26. The thick film dielectric electroluminescent display of claim 25, further comprising;

a rigid heat resistant substrate;

said electrode layer placed adjacent said substrate, a phosphor film deposited on said thick film dielectric layer; and an upper electrode layer comprising an optically transparent electrically conductive film provided above said phosphor film.

27. The display of claim 26, wherein said layer of encapsulating material comprises a compound with a high dielectric constant.

28. The display of claim 27, wherein said compound is barium titanate.

29. The display of claim 28, wherein said material is provided as a layer with a thickness of about 10 nm to 500 nm.

30. The display of claim 28, wherein said barium titanate has a thickness of about 30 nm to about 60 nm.

31. The display of claim 26, further comprising a sealing layer over the entire display to protect from moisture and/or atmospheric contaminants.

32. The display of claim 25, wherein said encapsulating material is indium tin oxide.

33. The display of claim 25, wherein said display further comprises an encapsulating layer having a thickness of about 10 nm to about 500 nm on said upper surface of said electrode.

34. The display of claim 33, wherein said encapulating layer is indium tin oxide provided on said upper surface of said electrode layer and has a thickness of about 100 nm to about 450 nm.

35. A method for stabilizing an electrode having an upper and lower surface within a thick film dielectric electroluminescent display having a thick film dielectric layer, said method comprising;

providing a layer of encapsulating material between said upper surface of said electrode and said thick film dielectric layer; and providing a layer of encapsulating material on said lower surface of said electrode, said encapsulating material on said upper and lower surface having a thickness of about 10 nm to about 500 nm and wherein said encapsulating material on said lower surface is selected from barium titanate and indium tin oxide, said encapsulating material reducing the risk of the electrode from becoming discontinuous and losing its electrical conductivity.

36. The method of claim 35, wherein said encapsulating material does not decrease the fraction of the applied voltage across a phosphor film present in a thick film dielectric electroluminescent display.

37. The method of claim 35, wherein said encapsulating material acts as a barrier to in-diffusion of species into said electrode from adjacent substrate and/or thick film dielectric structures present in a thick film dielectric electroluminescent display.

38. The method of claim 35, wherein said electrically conductive metallic film has a surface oxide layer and said encapsulating material minimizes chemical reduction of said surface oxide layer.

39. The method of claim 38, wherein said encapsulating material a greater tendency to donate oxygen to a surface of said electrode than scavenge oxygen from said electrode.

40. The method of claim 35, wherein said material is a dense crystalline material having a crystal structure that is not disrupted in the presence of a reducing agent selected from the group consisting of hydrogen sulfide, sulfur, sulfur vapour and sulfide bearing vapours.

41. The method of claim 35, wherein said encapsulating material is an oxide.

42. The method of claim 41, wherein said oxide is indium tin oxide.

43. The method of claim 35, wherein said encapsulating material is a compound having a high dielectric constant.

44. The method of claim 43, wherein said compound is barium titanate.

45. The method of claim 35, wherein said encapsulating material on said upper surface has a thickness of about 25 nm to about 450 nm.

46. The method of claim 45, wherein said encapsulating material on said upper surface has a thickness of about 100 nm to about 450 nm.

47. The method of claim 45, wherein said electrode has a thickness of about 100 nm to about 1000 nm.

48. The method of claim 47, wherein said electrode has a thickness of about 150 nm to about 250 nm.

49. The method of claim 47, wherein said electrode is a metallic gold film.

50. The method of claim 45, wherein said encapsulating material increases adhesion between the electrode, and a substrate material that forms part of the thick film dielectric electroluminescent display.

51. The method of claim 35, wherein said encapsulating material provided on said lower surface of said electrode layer has a thickness of about 10 nm to about 60 nm.

52. The method of claim 51, wherein said encapsulating material has a of about 30 nm to about 60 nm.

53. The method of claim 35, wherein said encapsulating material provided on both said upper and lower surfaces of said electrode comprises indium tin oxide.

54. The method of claim 35, wherein said encapsulating material provided on both said upper and lower surfaces of said electrode comprises barium titanate.

55. The method of claim 35, wherein said encapsulating material provided on said upper surface of said electrode is indium tin oxide and said encapsulating material provided on said lower surface of said electrode is barium titanate.

56. The method of claim 35, wherein said encapsulating material provided on said upper surface of said electrode is barium titanate and said encapsulating material provided on said lower surface of said electrode is indium tin oxide.

57. The method of claim 35, wherein said encapsulating material is provided by sputtering.

58. The method of claim 35, wherein said encapsulating material increases adhesion between the electrode and a thick dielectric layer present within the thick film dielectric electroluminescent display.

59. A stabilized electrode comprising;

an electrically conductive gold film layer having an upper surface and a lower surface, said gold film having a thickness of about 100 nm to about 1000 nm;

a thick film dielectric layer provided adjacent said upper surface;

a layer of indium tin oxide provided between said thick film dielectric layer and said upper surface of said gold film layer having a thickness of about 20 nm to about 500 nm; and a layer of indium tin oxide provided on the lower surface of said gold layer having a thickness of about 10 nm to about 60 nm;

wherein said stabilized electrode is present within a thick film dielectric electroluminescent display.

60. A stabilized electrode comprising;

an electrically conductive gold film layer having an upper surface and a lower surface, said gold film layer having a thickness of about 100 nm to about 1000 nm;

a thick film dielectric layer provided adjacent said upper surface;

a layer of barium titanate having a thickness of about 20 nm to about 500 nm provided between said thick film dielectric layer and said upper surface of said gold layer; and a layer of barium titanate having a thickness of about 10 nm to about 60 nm provided on the lower surface of said gold layer;

wherein said stabilized electrode is present within a thick film dielectric electroluminescent display.

61. A stabilized electrode for a thick film dielectric electroluminescent display, said electrode comprising;

an electrically conductive gold film layer having an upper surface and a lower surface, said gold film having a thickness of about 100 nm to about 1000 nm;

a thick film dielectric layer provided adjacent said upper surface;

a layer of indium tin oxide provided between said thick film dielectric layer and said upper surface of said gold film layer and a layer of indium tin oxide provided on the lower surface of said gold film layer.

62. A stabilized electrode for a thick film dielectric electroluminescent display, the electrode comprising;

an electrically conductive gold film layer having an upper surface and a lower surface, said gold film layer having a thickness of about 100 nm to about 1000 nm;

a thick film dielectric layer provided adjacent said upper surface;

a layer of barium titanate provided between the upper surface and said thick film dielectric layer and a layer of barium titanate provided on the lower surface of said gold layer.

63. A stabilized electrode for a thick film dielectric electroluminescent display, the electrode comprising;

an electrically conductive gold film layer having an upper surface and a lower surface, said gold film layer having a thickness of about 100 nm to about 1000 nm;

a thick film dielectric layer provided adjacent said upper surface;

a layer of indium tin oxide provided between said upper surface of said gold layer and said thick film dielectric layer, said layer of indium tin oxide having a thickness of about 10 nm to about 500 nm.

64. The stabilized electrode of claim 63, wherein said thickness is about 25 nm to about 450 nm.

65. The stabilized electrode of claim 64, wherein said thickness is about 100 nm to about 450 nm.

66. The stabilized electrode of claim 63, wherein said electrode is provided within a thick film dielectric electroluminescent device.

* * * * *